US006601497B2

(12) United States Patent
Ghiorse et al.

(10) Patent No.: US 6,601,497 B2
(45) Date of Patent: Aug. 5, 2003

(54) ARMOR WITH IN-PLANE CONFINEMENT OF CERAMIC TILES

(75) Inventors: Seth R. Ghiorse, Bel Air, MD (US); David M. Spagnuolo, Newark, DE (US); Melissa A. Klusewitz, Delta, PA (US); John R. Brown, Conowingo, MD (US); Pangiotis Blanas, Baltimore, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 36 days.

(21) Appl. No.: 09/840,692

(22) Filed: Apr. 24, 2001

(65) Prior Publication Data

US 2002/0178900 A1 Dec. 5, 2002

(51) Int. Cl.[7] ..... F41H 5/04

(52) U.S. Cl. ..... 89/36.02; 89/36.05; 89/36.08; 89/36.11; 109/49.5

(58) Field of Search ..... 89/36.02, 36.05, 89/36.08, 36.11; 109/49.5

(56) References Cited

U.S. PATENT DOCUMENTS

| | | | | |
|---|---|---|---|---|
| 3,924,038 A | * | 12/1975 | McArdle et al. | 2/2.5 |
| 4,911,061 A | * | 3/1990 | Pivitt et al. | 89/36.02 |
| 5,738,925 A | * | 4/1998 | Chaput | 2/2.5 |
| 5,824,940 A | * | 10/1998 | Chediak et al. | 89/36.02 |

FOREIGN PATENT DOCUMENTS

| | | | | |
|---|---|---|---|---|
| DE | 366 078 | * | 12/1922 | 89/36.02 |
| FR | 2 602 038 | * | 1/1998 | |
| GB | 2 276 934 A | * | 10/1994 | |
| WO | WO 94/01732 | * | 1/1994 | 89/36.02 |
| WO | WO 94/07105 | * | 3/1994 | 89/36.02 |

OTHER PUBLICATIONS

Ghiorse et al., "Lightweight Confinement of Ceramic Ballistics Tiles for Higher Mass Efficiency" May 4, 2000, 3rd Joint Classified Ballistics Symposium, San Diego, CA, 12 pages.

* cited by examiner

*Primary Examiner*—Stephen M. Johnson
(74) *Attorney, Agent, or Firm*—Paul S. Clohan, Jr.; Edward L. Stolarun

(57) ABSTRACT

An armor component includes a tile having a perimeter; and a wrapping material wrapped around the perimeter of the tile. An armor system includes a back plate; at least one tile array layer disposed on the back plate, the at least one tile array layer comprising a plurality of armor components wherein each armor component comprises a tile having a perimeter wrapped with a wrapping material; and a top layer disposed on the at least one tile array layer.

16 Claims, 3 Drawing Sheets

ARMOR WITH IN-PLANE CONFINEMENT OF CERAMIC TILES

STATEMENT OF GOVERNMENT INTEREST

The invention described herein may be manufactured and used by or for the Government of the United States of America for government purposes without the payment of any royalties therefor.

BACKGROUND OF THE INVENTION

The present invention relates in general to protective armor, and, in particular, to ceramic-based integral armor.

Desired armor protection levels can usually be obtained if weight is not a consideration.

However, in many armor applications, there is a premium put on weight. Some areas of application where lightweight armor are important include ground combat and tactical vehicles, portable hardened shelters, helicopters, and various other aircraft used by the Army and the other Services. Another example of an armor application in need of reduced weight is personnel body armor worn by soldiers and law enforcement personnel.

There are two prevalent hard passive armor technologies in general use. The first and most traditional approach makes use of metals. The second approach uses ceramics. Each material has certain advantages and limitations. Broadly speaking, metals are more ductile and are generally superior at withstanding multiple hits. However, they typically have a large weight penalty and are not as efficient at stopping armor-piercing threats. Ceramics are extraordinarily hard, strong in compression, lighter weight, and brittle, making them efficient at eroding and shattering armor-piercing threats, but not as effective at withstanding multiple hits. Lighter-weight metallic and ceramic armor designs are known. For example, metals such as titanium and aluminum alloys can replace traditional steel to cut weight. Ceramics, such as aluminum oxide, silicon carbide, and boron carbide, are used in combination with a supporting backing plate to achieve even lighter armor.

State-of-the-art integral armor designs typically work by assembling arrays of ballistic grade ceramic tiles within an encasement of polymer composite plating. Such an armor system will erode and shatter projectiles, including armor-piercing projectiles, thus creating effective protection at reduced weight. Various designs are in current use over a range of applications. Substantial development efforts are ongoing with this type of armor, as it is known that its full capabilities are not being utilized. For example, there is a large body of information which shows that confining the ceramics results in an increase in penetration resistance.

In the laboratory, ceramics show much higher performance when their boundaries are heavily confined. The two key parameters are suppression of cracked tile expansion and putting the ceramic in an initial state of high compressive stress to delay or stop it from going into a state of tensile stress during impact. The problem is to devise methods to realize some or all of this confinement effect so it can be reduced to practical application in real armor systems. If the ceramic tile is not encased, the fractured pieces can move away easily, and residual protection is lost. Snedeker, et al. used a hybrid metal/ceramic approach in U.S. Pat. No. 5,686,689. Ceramic tiles were placed into individual cells of a metallic frame consisting of a backing plate and thin surrounding walls. A metallic cover was then welded over each cell, encasing the ceramic tiles.

Multiple hits are a serious problem with ceramic-based armors. Armor-grade ceramics are extremely hard, brittle materials, and after one impact of sufficient energy, the previously monolithic ceramic will fracture extensively, leaving many smaller pieces and a reduced ability to protect against subsequent hits in the same vicinity. Further, when the impact is at sufficient energy and velocity, collateral damage typically occurs to the neighboring ceramic tiles. Schade, et al. (U.S. Pat. No. 5,705,764) used a combination of polymers and polymer composites to encase the ceramic tiles in a soft surround to isolate the tiles from one another, reducing collateral damage.

An object of the present invention is to increase penetration resistance and decrease collateral damage of ceramic tile armor arrays, while maintaining or lowering the armor system weight.

Further objects, features and advantages of the invention will become apparent from the following detailed description taken in conjunction with the following drawing.

BRIEF DESCRIPTION OF THE DRAWINGS

Throughout the Figures, reference numerals that are the same refer to the same features.

DETAILED DESCRIPTION OF THE PREFERRED EMBODIMENTS

The present invention is an improvement to ceramic-based integral armor. The invention results in superior ballistic characteristics of the armor system with no increase in the armor weight. The performance improvement can optionally be manifested as equal protection at a lighter weight, or any balance of desired protection/weight tradeoffs thereof. The invention typically applies to polymer-composite-backed ceramic armors where the ceramic is in the form of a tile, but it may be applied to any armor incorporating ballistic tiles. The design function is accomplished by wrapping a high-strength material around the tile perimeter to confine the tile from lateral expansion when impacted. These individual tile modules are then laid into multiple-tile arrays to obtain broad area coverage of a contoured structure.

One advantage of the invention is an increase in the ballistic penetration resistance of ceramic-based tile armor with a simultaneous decrease in the armor system weight. A second advantage is the reduction or elimination of collateral damage to surrounding ceramic tiles.

Given a ceramic-based integral armor, there are four key criteria—penetration resistance, multiple hit performance, rear-face deflection, and weight. Laterally wrapping the ceramic tiles with a small amount of high-strength banding material has been found to significantly increase penetration resistance and reduce weight, while also reducing collateral damage. The banding material and tile edge design can take on a variety of forms and are not limited to any particular material, tile shape, or tile edge geometry. Several possible wrapping materials are high-strength fibers such as graphite, glass, aramid, liquid crystal, PBO, or other high-strength fiber or other high-strength material, such as a metallic band or metallic wire.

The tile edge can be tailored in a variety of ways, and has been found to affect ballistic performance. For example, the tile can be made to have a slightly recessed edge to hold the banding material to keep the inter-tile gap unchanged. Another key edge feature in non-circular tile arrays, such as hexagonal-shaped tiles, is vertex radius. Computational analysis clearly shows that small amounts of smoothing of the vertex have a large effect on the stress concentration factor. This analysis is supported by ballistic test results.

A circular disk is the optimal shape from a stress standpoint, however, circles do not nest effectively, making it necessary to use special means, such as a second tile layer, to fully cover the protected area. While rectangular tiles can be used, the hexagonal tile also offers complete coverage along with less acute vertices and optimal use of each ceramic tile in contributing to energy dissipation during the ballistic event. As will be seen, this consideration is important to the present invention.

Figure 1:
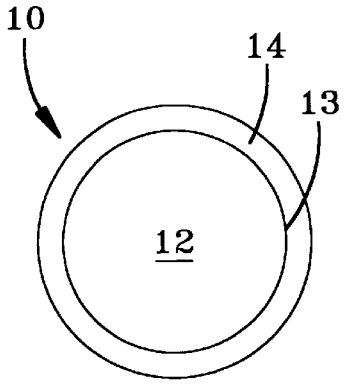
FIG. 1 is a top view of an armor component according to the invention.

FIG. 1 is a top view of an armor component 10 according to the present invention. Armor component 10 includes a tile 12 having a perimeter 13 and a wrapping material 14 wrapped around the perimeter 13 of the tile 12. Preferably, the wrapping material 14 precompresses the tile 12. Without precompression, at least simple intimate contact is needed.

In one embodiment, the tile 12 comprises a ceramic material selected from the group consisting of aluminum oxide, silicon carbide, boron carbide, titanium diboride, aluminum nitride, silicon nitride and tungsten carbide. Tile 12 may also be made of any hard, high compressive strength material having a Vickers hardness of about 12 GPa or greater and a compressive strength of about 2 GPa or greater.

Wrapping material 14 may comprise one of a high-strength fiber, a high-strength fiber in a polymer composite matrix, a high-strength fiber in a metal matrix, a high-strength metallic band, and a high-strength metallic wire.

More specifically, the general categories of wrapping material 14 may comprise any and all grades of organic and inorganic fibers and any and all grades of metallic banding, wire, or fiber, including steel alloys, aluminum alloys, and titanium alloys. Some examples of inorganic fibers include E glass and S2 glass and other high silica fibers, quartz, boron, silicon carbide, silicon nitride, alumina, and titanium carbide. Other materials for wrapping material 14 include any and all pitch- and polyacrylonitrile (PAN)-based carbon fibers including standard modulus grades, intermediate modulus grades, high modulus grades, and ultra-high modulus grades. Some examples are Thornel P-25, Magnamite AS4, Torayca M30 and T1000, Magnamite IM7, Torayca M40J, Thornel P-55 S; Torayca M60J; and Thornel P-120. Other materials for wrapping material 14 include any and all grades of aramid, meta-aramid, and para-aramid fiber, for example Twaron, Kevlar 29, 129, 49, and KM2. Also, any and all grades of other polymeric fibers, for example, Spectra 900, Spectra 1000, Dyneema SK60, polyphenylene sulfide, polyetheretherketone, Vectran HS, Vectran M, polyimide, polyetherimide, and polyamide-imide. Also, any and all grades of polybenzimidazole-based fiber, including Zylon-AS and Zylon-HM.

Where wrapping material 14 is a composite material, the binding matrix may include any and all grades of thermosetting and thermoplastic polymers. Some examples include epoxy, polyester, vinyl ester, polyurethane, silicone, butyl rubber, phenolic, polyimide, bismaleimide, cyanate ester, polyetheretherketone, polyphenylenesulfide, polysulfone, polyethylene, polypropylene, polycarbonate, polyetherimide, polyethylenesulfide, acrylic, acylonitrile butadiene styrene, and nylon.

Figure 2A:
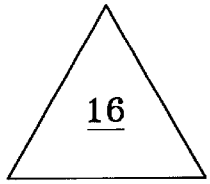
FIGS. 2A–2D show exemplary shapes for an armor tile.
Figure 2B:
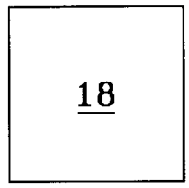
Figure 2C:
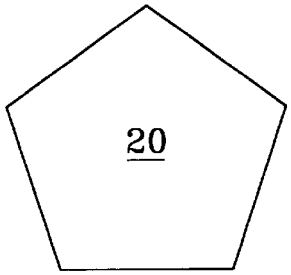
Figure 2D:
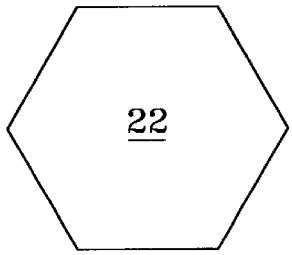

FIG. 1 shows a circular shaped tile 12. FIGS. 2A–2D show some other exemplary shapes for the armor tile. FIG. 2A shows a triangular tile 16, FIG. 2B shows a quadrilateral tile 18, FIG. 2C shows a pentagonal tile 20 and FIG. 2D shows a hexagonal tile 22. The shapes shown in FIGS. 1 and 2A–2D are by way of example only. Other polygonal shapes may be used. In addition, the shape of the tile need not be a regular geometric shape. The tile may have any shape needed for a particular application.

Figure 3A:
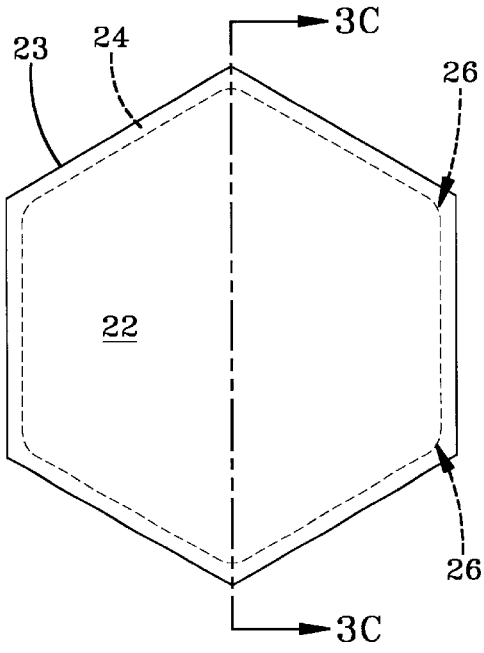
FIG. 3A is a top view of a hexagonal tile.

FIG. 3A is a top view of a hexagonal tile 22. The perimeter 23 of tile 22 includes an optional recess 24 for receiving at least a portion of the wrapping material 14. Recess 24 may be large enough to encase all of wrapping material 14 or it may encase only a portion of wrapping material 14. In addition, the wrapping material 14 may be applied directly to the perimeter of the tile without a recess.

Figure 3B:
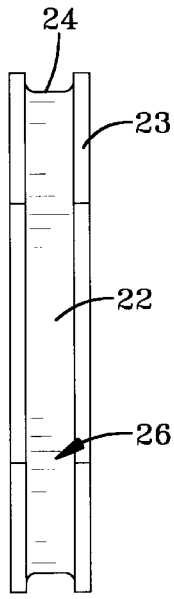
FIG. 3B is a side view of the tile of FIG. 3A.
Figure 3C:
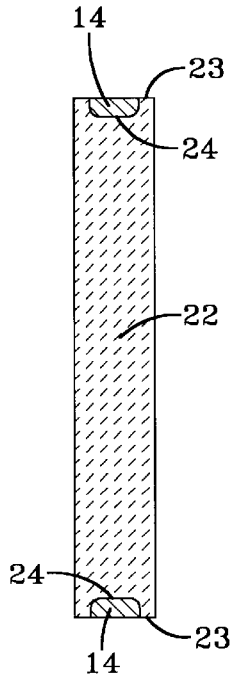
FIG. 3C is a sectional view of FIG. 3A.

FIG. 3C is a sectional view of FIG. 3A showing all of wrapping material 14 disposed in recess 24 of tile 22. In one embodiment, a thickness of the wrapping material 14 is about 0.030 inches and a depth of the recess 24 is about 0.030 inches. While FIG. 3A shows a hexagonal tile 22, it should be understood that any and all shapes of the tile may include a recess that partially or completely encases wrapping material 14.

FIG. 3B is a side view of the tile 22 of FIG. 3A. At the vertices 26 of the recess 24, it is preferable, but not required, that the vertices 26 are smoothed. For the tile 22, it is preferable that the vertices 26 are smoothed by some small amount, for example, to a radius of about 0.125 inches. Smoothing of the vertices is advantageous for any shape of tile having a vertex. Also, even if the tile perimeter is not recessed to receive wrapping material 14, it is still advantageous to smooth any vertices on the tile perimeter.

Figure 4A:
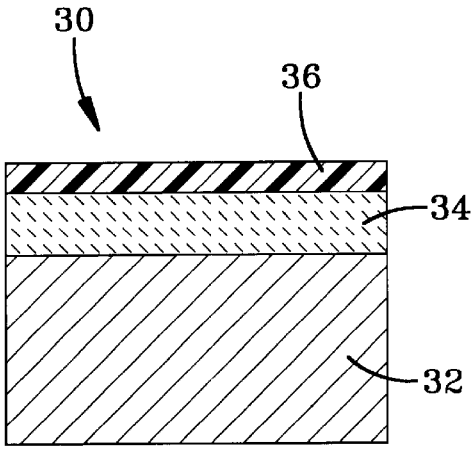
FIGS. 4A and 4B schematically show two embodiments of armor systems according to the invention.
Figure 4B:
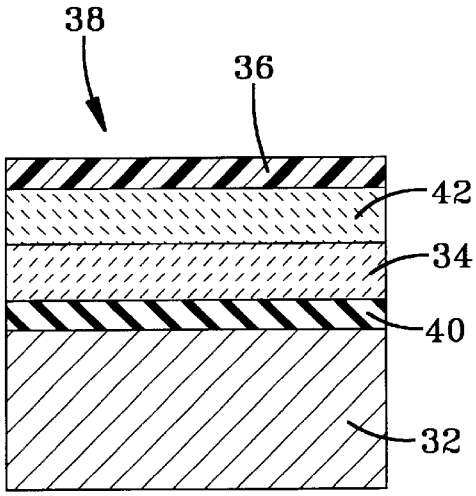

Another aspect of the invention is an armor system. FIGS. 4A and 4B schematically show two embodiments of armor systems 30, 38, respectively, according to the invention. FIG. 4A shows an armor system 30 comprising a back plate 32, at least one tile array layer 34 disposed on the back plate 32 and a top layer 36 disposed on the at least one tile array layer 34. The armor system 38 of FIG. 4B comprises a back plate 32, a shock absorbing layer 40 disposed on the back plate 32, a first tile array layer 34 disposed on the shock absorbing layer 40, a second tile array layer 42 disposed on the first tile array layer 34 and a top layer 36 disposed on the second tile array layer 42.

The tile array layers 34 and 42 are comprised of a plurality of armor components 10 wherein each armor component 10 comprises a tile having a perimeter wrapped with a wrapping material, as discussed above with respect to the armor component 10. Preferably, the wrapping material for each tile precompresses that tile. The materials of construction, shapes and features of the armor components 10 used in the armor systems 30, 38 are as discussed previously. The tile array layers 34, 42 may be comprised of a variety of shapes of components 10. The important feature is that the tile array layers provide as much coverage as possible. To this end, various regular and irregular shapes may be combined within a single layer to obtain as much coverage as possible.

The back plate 32 may also serve as a structural component of the object being protected. Back plate 32 is preferably made of a polymer or metal matrix composite material, a metal or a metal alloy. The shock absorbing layer 40 is preferably made from a compliant or crushable material, such as rubber or metallic foam. The top layer 36 functions to keep the tile array layers 34, 42 in position. The top layer 36 may be made of a variety of material. A typical top layer 36 may be made of polymer composite material. The thickness of top layer 36 varies with design. A typical thickness for top layer 36 may be about 0.125 inches.

Figure 5A:
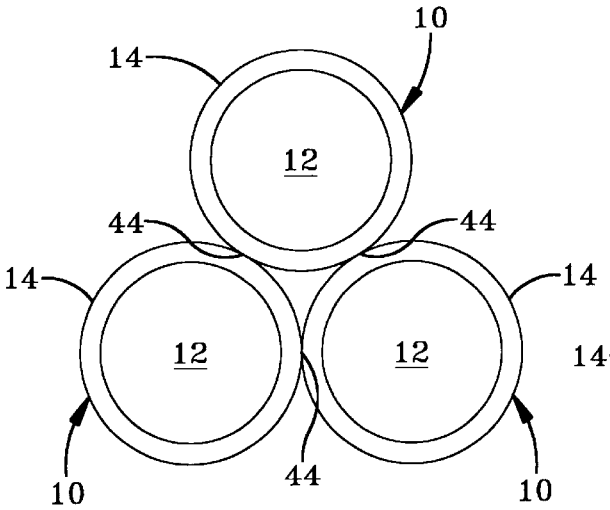
FIGS. 5A and 5B schematically show two methods of arranging armor components in an array.
Figure 5B:
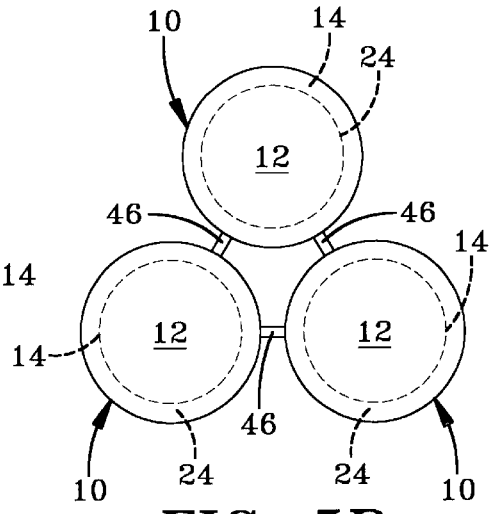

FIGS. 5A and 5B schematically show two methods of arranging armor components 10 in a tile array layer 34, 42. FIGS. 5A and 5B represent only a portion of a tile array layer 34, 42. While circular tiles 12 are shown in FIGS. 5A and 5B, the methods of arranging the components 10 are applicable to any shape of tile.

In FIG. 5A, the wrapping material 14 extends beyond the perimeter of tiles 12. Thus, the tiles 12 may have no recess for receiving the wrapping material 14 or the size of the wrapping material 14 may be such that it is only partially disposed in a recess in the perimeter of the tile. In either case, the components 10 are arranged such that the wrapping material 14 of one component 10 contacts the wrapping material 14 of an adjacent component 10. Points of contact are indicated by reference numeral 44.

In FIG. 5B, wrapping material 14 is completely disposed in recesses 24 in tiles 12. Spacers 46 are disposed between adjacent components 10 to create an air gap therebetween. Spacers 46 are preferably made of self-adhering rubber and of a size to create an air gap of about 0.020 inches between components 10. Spacers 46 may also be used in the arrangement shown in FIG. 5A if an air gap is desired between the wrapping material 14 of adjacent tiles 12.

An example of an tile array layer 34 is one comprising circular tiles that are assembled into a nested array, with the gaps between the circular tiles filled with three-sided tiles whose sides are concave so as to obtain as much coverage as possible. Another possible configuration using circular tiles is to use two layers 34, 42. The layers 34, 42 are aligned to produce complete area coverage, i.e., any gaps in the first layer 34 are covered by tiles in the second layer 42.

A tile array layer 34 may also comprise polygon-shaped tiles, such as triangles, squares, rectangles, and hexagons, or combinations of polygons thereof, which nest to give complete coverage in one layer. In another configuration, polygon-shaped tiles or combinations thereof are used in a first layer 34 and any gaps in the first layer 34 are protected by a second layer 42 to obtain complete coverage. It is frequently desired to achieve complete coverage in one layer. Typical tile shapes used for this are hexagonal and square.

EXAMPLES

Figure 6:
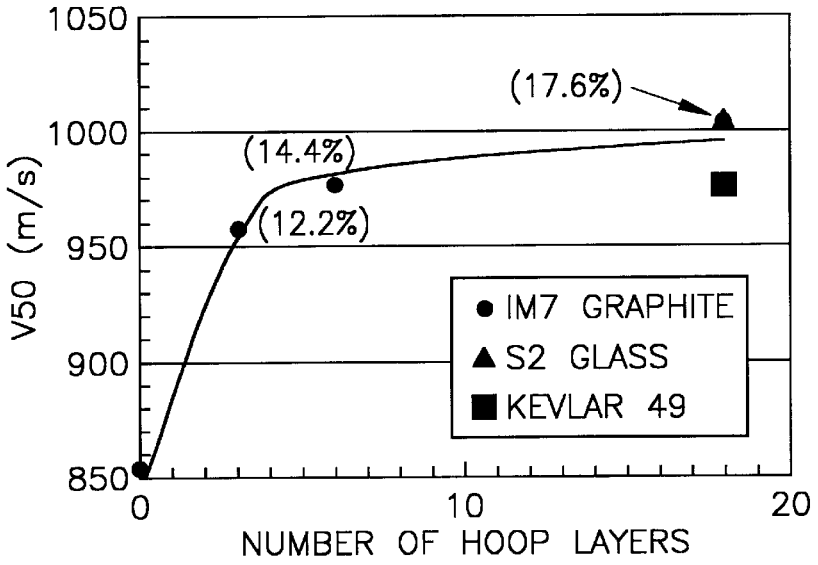
FIG. 6 is a plot of V50 values versus number of hoop layers for three materials.

Several embodiments of the invention have been fabricated and tested. Computational analysis has also been done to assess the stress state at the vertices in hexagonal tiles. The first prototype consisted of an as-received aluminum oxide hexagonal tile (99.5% purity) wrapped with 18 layers of high-strength graphite/epoxy composite (about 2 grams/layer). The wrapped tile was placed onto a test bed base plate configuration and shot with a heavy machine gun bullet. When compared with the baseline unwrapped tile, it was found that the wrap had caused the V50 value to increase by 17.6%. See Table 1 below and FIG. 6. Similar results were obtained with other high performance fibers (S2 glass and aramid). These tiles were also wrapped with three and six layers of graphite and resulted in V50 increases of 12.2% and 14.4% respectively, as shown in Table 1 and FIG. 6.

TABLE 1

| FIBER TYPE | NUMBER OF HOOP LAYERS | V50 (m/s) | V50 INCREASE (m/s) | V50 INCREASE (%) |
|---|---|---|---|---|
| IM7 Graphite | 0 | 854 ± 8 | 0 | 0 |
| IM7 Graphite | 3 | 958 ± 8 | 104 | 12.2 |
| IM7 Graphite | 6 | 977 ± 7 | 123 | 14.4 |
| IM7 Graphite | 18 | 1004± 6 | 150 | 17.6 |
| S2 Glass | 18-Equivalent | 1005 ± 7 | 151 | 17.7 |
| Kevlar 49 | 18-Equivalent | 976 ± 14 | 122 | 14.3 |

Figure 7:
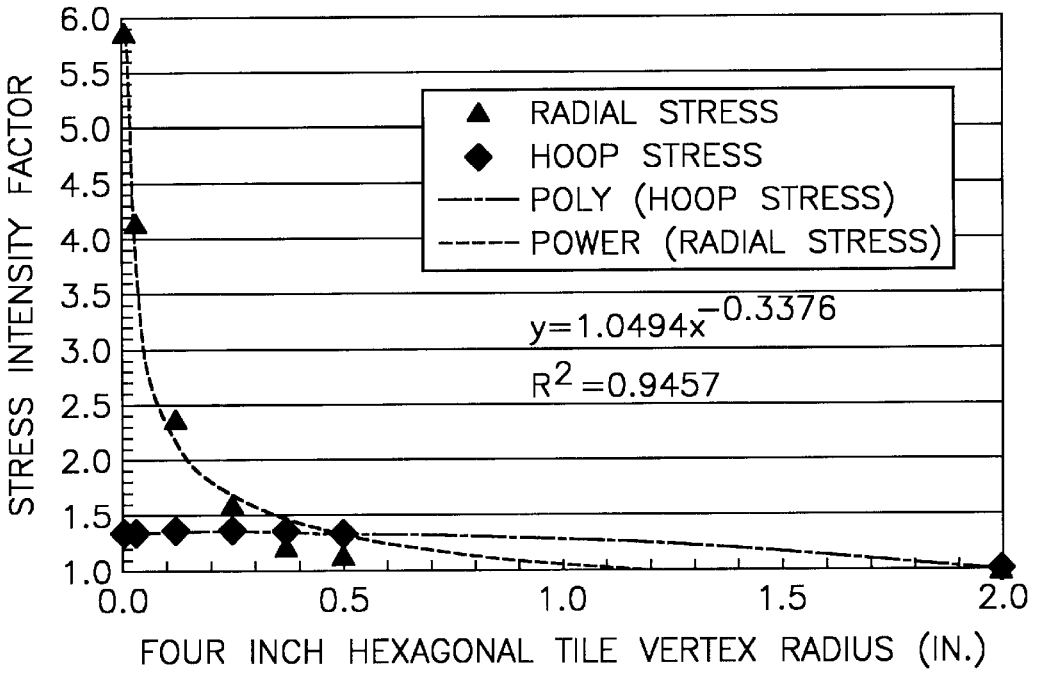
FIG. 7 is a plot of stress intensity factor versus vertex radius for a four inch hexagonal tile.

In ballistic testing, the fiber wrap consistently fractured at the tile vertices. Stress analysis at the vertex indicates that "sharp" as-received hexagonal tiles have a radial stress concentration factor of 5.85 and a hoop stress concentration factor of 1.34 compared to a four-inch circular disk (the disk is the optimal geometry for stress). The analysis shows that slightly rounding the vertices to, for example, 0.125-inch radius will reduce the radial stress concentration factor to 2.35-a 40% reduction (See FIG. 7). The hoop stress remains essentially unchanged. This implies the distinct possibility of increasing the V50 penetration resistance even higher by paying careful attention to vertex shape. The model prediction was validated with ballistic testing, which showed the composite wrap from a radiused tile clearly had more extensive damage, indicating that it had stored up significantly more strain energy prior to failure.

While the invention has been described with reference to certain preferred embodiments, numerous changes, alterations and modifications to the described embodiments are possible without departing from the spirit and scope of the invention, as defined in the appended claims and equivalents thereof.

What is claimed is:

1. An armor component comprising:

a polygonal tile having a perimeter;

a wrapping material wrapped around the perimeter of said polygonal tile; and wherein said polygonal tile has vertices which are smoothed to a radius of about 0.125 inches to thereby significantly reduce the radial stress concentration factor of said polygonal tile.

2. The armor component of claim 1 wherein said polygonal tile comprises a ceramic material selected from the group consisting of aluminum oxide, silicon carbide, boron carbide, titanium diboride, aluminum nitride, silicon nitride and tungsten carbide.

3. The armor component of claim 1 wherein a thickness of wrapping material is about 0.030 inches.

4. The armor component of claim 1 wherein the perimeter of said polygonal tile includes a recess and at least a portion of the wrapping material is disposed in the recess.

5. The armor component of claim 4 wherein a depth of the recess is about 0.030 inches.

6. The armor component of claim 1 wherein the wrapping material comprises one of a fiber, a fiber in a polymer composite matrix, a fiber in a metallic matrix, a metallic band, and a metallic wire.

7. The armor component of claim 1 wherein said polygonal tile comprises a material having a Vickers hardness of about 12GPa or greater and a compressive strength of about 2 GPa or greater.

8. The armor component of claim 1 wherein the wrapping material precompresses the tile.

9. The armor component of claim 1 wherein said polygonal tile has a hexagon shape.

10. An armor system, comprising:

a back plate;

at least one tile array layer disposed on the back plate, the at least one tile array layer comprising a plurality of armor components wherein each armor component comprises a polygonal tile having a perimeter wrapped with a wrapping material, and each said polygonal tile having vertices which are smoothed to a radius of about 0.125 inches to thereby significantly reduce the radial stress concentration factor of said polygonal tile; and a top layer disposed on the at least one tile array layer.

11. The armor system of claim 10 further comprising a shock absorbing layer disposed between the back plate and the at least one tile array layer.

12. The armor system of claim 10 wherein the wrapping material for each tile precompresses each tile.

13. The armor system of claim 10 wherein the plurality of armor components are placed adjacent each other such that the wrapping material of one armor component contacts the wrapping material of an adjacent armor component.

14. The armor system of claim 10 further comprising spacers placed between the plurality of armor components to create air gaps between adjacent armor components.

15. The armor system of claim 10 wherein the perimeter of each tile includes a recess and at least a portion of the wrapping material is disposed in the recess.

16. The armor system of claim 10 wherein at least some of said armor components are hexagon shaped tiles.

* * * * *